US009095192B2

(12) United States Patent
Hamada

(10) Patent No.: US 9,095,192 B2
(45) Date of Patent: Aug. 4, 2015

(54) SLIDER FOR SLIDE FASTENER

(75) Inventor: Yoshikazu Hamada, Toyama (JP)

(73) Assignee: YKK Corporation (JP)

( * ) Notice: Subject to any disclaimer, the term of this patent is extended or adjusted under 35 U.S.C. 154(b) by 210 days.

(21) Appl. No.: 13/876,572

(22) PCT Filed: Sep. 29, 2010

(86) PCT No.: PCT/JP2010/067004

§ 371 (c)(1),
(2), (4) Date: Mar. 28, 2013

(87) PCT Pub. No.: WO2012/042620

PCT Pub. Date: Apr. 5, 2012

(65) Prior Publication Data

US 2013/0174387 A1 Jul. 11, 2013

(51) Int. Cl.
*A44B 19/30* (2006.01)

(52) U.S. Cl.
CPC ..... *A44B 19/303* (2013.01); *A44B 19/306* (2013.01); *A44B 19/308* (2013.01); *Y10T 24/2566* (2015.01); *Y10T 24/2571* (2015.01); *Y10T 24/2586* (2015.01)

(58) Field of Classification Search
CPC .... A44B 19/262; A44B 19/30; A44B 19/303; A44B 19/305; A44B 19/306; A44B 19/308; Y10T 24/2566; Y10T 24/2571; Y10T 24/2568; Y10T 24/2586
USPC ..... 24/419–424, 429
See application file for complete search history.

(56) References Cited

U.S. PATENT DOCUMENTS

| | | | | |
|---|---|---|---|---|
| 1,721,144 | A | | 7/1929 | Blair |
| 3,133,328 | A | | 5/1964 | Huelster |
| 5,152,036 | A | * | 10/1992 | Oda et al. ..... 24/424 |
| 6,009,602 | A | | 1/2000 | Terada |
| 6,637,078 | B2 | | 10/2003 | Nagata et al. |

FOREIGN PATENT DOCUMENTS

| | | | |
|---|---|---|---|
| JP | 3-2955502 | A | 12/1991 |
| JP | 11-178615 | A | 7/1999 |
| JP | 2002-315609 | A | 10/2002 |
| JP | 2007-75196 | A | 3/2007 |
| JP | 1382218 | | 3/2010 |

OTHER PUBLICATIONS

Office Action, Japanese Patent Application No. 2012-536066, mailed Jul. 15, 2014.

(Continued)

*Primary Examiner* — Robert J Sandy
*Assistant Examiner* — Abigail Morrell
(74) *Attorney, Agent, or Firm* — Kilpatrick Townsend & Stockton LLP

(57) ABSTRACT

A slider for a slide fastener includes a slider main body, a pull tab, a stopper hook having one end configured to be engaged with fastener elements to obstruct the slider main body from moving, a spring portion, a cam portion configured to urge the pull tab in a direction in which the pull tab returns to a lay-down state where the pull tab is laid down toward one side of the slider main body using an elastic force of the spring portion when the pull tab pivots from the lay-down state to an erected state, and regulating portions configured to obstruct the pull tab from pivoting further from the erected state so that the pull tab is obstructed from pivoting to the other side of the slider main body.

7 Claims, 15 Drawing Sheets

(56) References Cited

OTHER PUBLICATIONS

International Preliminary Report on Patentability, PCT Application No. PCT/JP2010/067004, mailed Apr. 16, 2013.

Office Action, Japanese Patent Application No. 2012-536066, mailed Dec. 24, 2014.

International Search Report, PCT Application No. PCT/JP2010/067004, mailed Jan. 11, 2011.

* cited by examiner

SLIDER FOR SLIDE FASTENER

This application is a national stage application of PCT/JP2010/067004 which is incorporated herein by reference.

TECHNICAL FIELD

The present invention relates to a slider for a slide fastener, and more particularly, to a slider for a slide fastener in which a pull tab stays in a lay-down state with respect to a slider main body in normal times, i.e. when the slider is not slid.

BACKGROUND ART

A slider for a slide fastener in which a pull tab stays in a lay-down state with respect to a slider main body is known in the related art (see e.g. Patent Document 1). The slider for a slide fastener disclosed in Patent Document 1 constantly maintains a pull tab in a lay-down state using the elastic force of a hinge spring by inserting a pin through the pull tab such that the pin is fitted into a bearing which protrudes from an upper blade of a slider body and disposing the hinge spring on the pin. In addition, the slider includes the slider body, a stopper hook which has the spring, the pull tab on which a cam surface is provided, a leaf spring which applies an elastic force to the cam surface, and a cover body which is fitted into the slider body and houses the leaf spring. The slider constantly maintains the pull tab in the lay-down state using the elastic force of the leaf spring that acts on the cam surface.

PRIOR ART DOCUMENT

Patent Document

Patent Document 1: Japanese Patent Application Publication No. 3-295502A

SUMMARY OF INVENTION

Problems to be Solved by Invention

However, the slider for a slide fastener disclosed in Patent Document 1 has a complicated structure. In addition, the weight of the slider is heavy due to its large size and it is difficult to reduce the size of the slider since the slider is configured such that the hinge spring can be disposed therein. In addition, since the slider is not designed such that it can be automatically assembled, the slider is manually mounted and mass production of the slider is difficult. In addition, since the pull tab can be lay down toward any one of the rear mouth side and the shoulder mouth side, the pull tab which has been lying in a lay-down state erects depending on usages. Therefore, there is a possibility that the slider may move freely.

Accordingly, the present invention has been made keeping in mind the above problems occurring in the related art, and an object of the present invention is to provide a slider for a slide fastener which can simplify the structure, realize miniaturization and lightness, and promote improvement in operability.

Means for Solving Problems

The object of the present invention is achieved by the following configurations.

(1) A slider for a slide fastener that includes: a slider main body configured to engage and disengage a pair of fastener elements; a pull tab which is attached to a pull tab attachment portion of the slider main body; a stopper hook having one end configured to be engaged with the fastener elements to obstruct the slider main body from moving; a spring portion; a cam portion configured to urge the pull tab in a direction in which the pull tab returns to a lay-down state where the pull tab is lay down toward one side of the slider main body using an elastic force of the spring portion when the pull tab pivots from the lay-down state to an erected state; and regulating portions configured to obstruct the pull tab from pivoting further from the erected state, so that the pull tab is obstructed from lying down to the other side of the slider main body.

(2) The slider for a slide fastener according to (1), wherein the regulating portions is comprised of pull tab-side regulating portions which are formed on the pull tab and slider-side regulating portions which are formed on the slider main body, and wherein the pull tab-side regulating portions abut against the slider-side regulating portions, thereby obstructing the pull tab from pivoting further from the erected state.

(3) The slider for a slide fastener according to (1) or (2), wherein the pull tab has a shaft portion, a pair of connecting rods which are connected to the shaft portion, and a knob portion which is connected to the pair of connecting rods, and wherein the pull tab-side regulating portions are provided on at least one of the shaft portion and the pair of connecting rods of the pull tab.

(4) The slider for a slide fastener according to any one of (1) to (3), wherein the pull tab-side regulating portions and the cam portion extend toward a pull tab opening portion which is defined by the shaft portion, the pair of connecting rods and the knob portion.

(5) The slider for a slide fastener according to any one of (1) to (4), wherein the regulating portions obstruct the pull tab from pivoting when a position where the spring portion comes into contact with the cam portion is within a range from a starting point to an end point of a cam surface of the cam portion.

(6) The slider for a slide fastener according to any one of (1) to (5), wherein the slider main body is comprised of a slider body and a cover body which is fixed to the slider body, wherein the cover body includes: a receiving portion which receives the stopper hook and the spring portion; and an opening portion provided with a partition plate which comes into contact with the shaft portion to pivotably hold the pull tab, and wherein the slider-side regulating portions are formed on a circumferential wall of the opening portion.

(7) The slider for a slide fastener according to any one of (1) to (5), wherein the slider-side regulating portions are provided on the pull tab attachment portion.

(8) The slider for a slide fastener according to any one of (1) to (5), wherein the slider-side regulating portions are erected on an upper blade of the slider main body.

(9) The slider for a slide fastener according to any one of (1) to (9), wherein the shaft portion of the pull tab comes into contact with the upper blade to be held due to the elastic force of the spring portion through the stopper hook.

(10) The slider for a slide fastener according to any one of (1) to (9), wherein the lay-down state is a state where the pull tab is lay down toward a rear mouth side of the slider main body, wherein the pull tab-side regulating portions are formed on an upper surface of the pull tab in the lay-down state, and wherein the slider-side regulating portions are formed at positions that face the upper surface of the pull tab when the pull tab pivots toward a shoulder mouth side of the slider main body.

Advantageous Effects of Invention

According to the slider for a slide fastener of the invention, the slider includes the spring portion, the cam portion which urges the pull tab using the elastic force of the spring portion in the direction in which the pull tab returns to the lay-down or lie down state when the pull tab pivots from the lay-down state where the pull tab is lay down toward one side of the slider body toward the erected state, and the regulating portions which obstruct the pull tab from pivoting further from the erected state. In order to obstruct the slider body from lying down toward the other side of the slider body, it is possible to constantly maintain the pull tab in the state where it is lay down toward one side, i.e. toward the rear mouth side, except that the pull tab is being operated. In addition, it is possible to prevent the pull tab from lying down toward the opposite side, e.g. toward the rear shoulder side, thereby improving operability. Furthermore, since the above-described functions are realized using a simple structure, it is possible to reduce the size and weight of the slider as well as assembling the slider using an automatic assembly apparatus.

EMBODIMENTS OF INVENTION

Hereinafter, embodiments of a slider for a slide fastener according to invention will be described in detail with reference to the accompanying drawings. In the following description, a shoulder mouth side refers to a side of the slider having a wider width through which fastener elements exit disengaged from each other, a rear mouth side refers to a side of the slider having a narrower width through which fastener elements exit engaged with each other. In addition, the shoulder mouth side is referred to as a front side, the rear mouth side is referred to as a rear side, a direction in which the slider slides is referred to as a front-back direction, a direction that perpendicularly intersects the front-back direction and is parallel to a fastener tape (not shown) is referred to as a left-right direction (width direction), and a direction that perpendicularly intersects both the front-back direction and the left-right direction is referred to as an up-down direction.

(First Embodiment)

First, with reference to FIG. 1 to FIG. 12, a first embodiment of the slider for a slide fastener according to the invention will be described.

Figure 1:
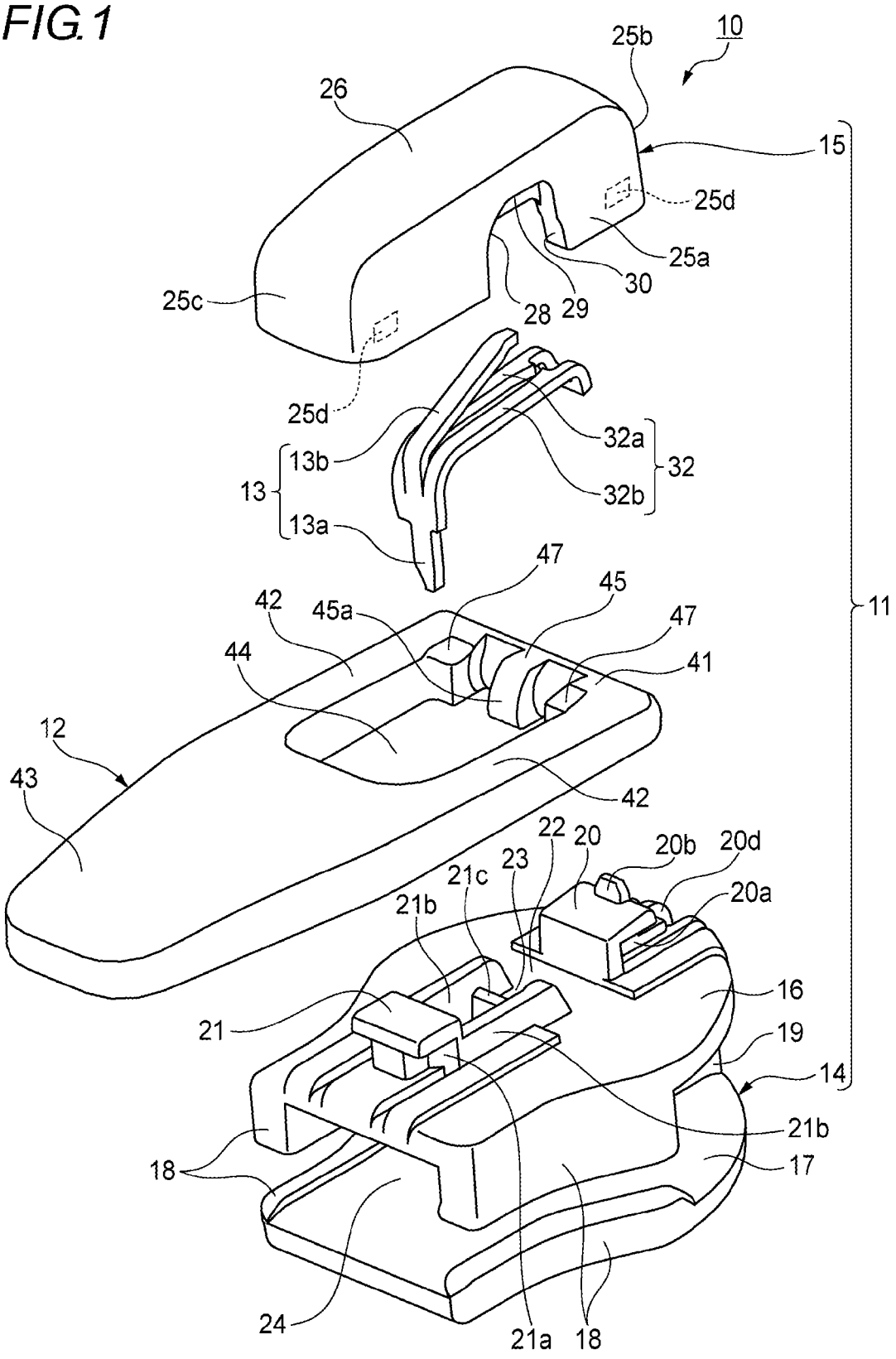
FIG. 1 is an exploded perspective view showing a first embodiment of a slider for a slide fastener according to the invention.

As shown in FIG. 1, a slider 10 for a slid fastener (hereinafter, referred to as simply a slider) includes a slider main body 11, a pull tab 12 and a stopper hook 13. The slider main body 11 includes a slider body 14 and a cover body 15.

The slider body 14 has substantially a trapezoidal shape when viewed in a top-plan view, and includes an upper blade 16 and a low blade 17 which are spaced apart from each other in the up-down direction and are arranged side by side and a guide post 19 which connects the upper and low blades 16 and 17 to each other. Each of the blades 16 and 17 has a pair of left and right flanges 18 which are formed along the left and right circumferences thereof. The flanges 18 include the upper flange formed on the upper blade 16 and the low flange formed on the low blade 17. The guide post 19 connects the two blades 16 and 17 to each other at the width-directional central portions in a shoulder mouth side. Between the two blades 16 and 17, a Y-shaped element guide path 24 is formed using the guide post 19 as a diverging point. A front attachment post 20 and a rear attachment post 21 are respectively erected on the front and rear sections in the upper surface of the upper blade 16 of the slider body 14. The front attachment post 20 and the rear attachment post 21 are integrally formed on the upper surface as members with which the cover body 15 is attached. The cover body 15 is configured as a holder of the pull tab as will be described later. Between the front attachment post 20 and the rear attachment post 21, a concave recess 22 is formed as a space into which a shaft portion 41 of the pull tab 12 which will be described later is pivotably fitted. In addition, in the state where the shaft portion 41 of the pull tab 12 is fitted into the concave recess 22, the front attachment post 20, when the cover body 15 is attached to the front attachment post 20 and the rear attachment post 21, the rear attachment post 21 and the cover body 15 form a pull tab attachment portion.

Recesses 20*a* and 21*a* which fix the cover body 15 by crimping are respectively formed in the left and right surfaces of the front end side of the front attachment post 20 and the left and right surfaces of the rear end side of the rear attachment post 21. A pair of longitudinal walls 21*b* is formed on the upper surface of the upper blade 16, between the front attachment post 20 and the rear attachment post 21. The pair of longitudinal walls 21*b* extends from the left and right ends of the front end surface of the rear attachment post 21 toward the front attachment post 20 and before the concave recess 22. In addition, the upper surface of the longitudinal walls 21*b* is formed to be lower than the upper surface of the rear attachment post 21. A connector wall 21*c* is formed on the inside surfaces of the pair of longitudinal walls 21*b* that are at the side of the front attachment post 20, and connects the inside surfaces of the pair of longitudinal walls 21*b* to each other. A substantially U-shaped recess 23 is defined by the pair of longitudinal walls 21*b* and the connector wall 21*c*. A hook hole 35 is formed in the portion of the upper blade 16 that is surrounded by the pair of longitudinal walls 21*b*, the connector wall 21*c* and the rear attachment post 21. The hook hole 35 extends through the upper blade 16 in the up-down direction, and is open toward the element guide path 24. In addition, a stepped portion 20*d* is formed in the portion of the upper blade 16 that is above the guide post 19 and more forward of the front attachment post 20, and a front wall protrusion 25*e* of the cover body 15 which will be described later can be inserted into the stepped portion 20*d* (see FIG. 6).

The cover body 15 has a ceiling portion 26 which is substantially rectangular, sidewalls 25*a* which surround the left and right sides and are substantially rectangular, and a front wall 25*b* and a rear wall 25*c* which surround the front and rear sides and are substantially. The cover body 15 also has a receiving portion 27 (see FIG. 6) which is formed inside the cover body 15 and receives the stopper hook 13. In addition, a guide recess 26*a* is formed in the undersurface of the receiving portion 27, i.e. the rear surface of the ceiling portion 26. The guide recess 26*a* urges a first leg portion 13*b* of the stopper hook 13 which will be described later while guiding the first leg portion 13*b*. In addition, a front wall protrusion 25*e* is formed on the front wall 25*b*, and extends longer than the rear wall 25*c* and the sidewalls 25*a*. In addition, the left and right sidewalls 25*a* have a substantially U-shaped opening portion 28 which extends from the undersurface of each sidewall toward the ceiling portion 26. In addition, a partition plate 29 is provided on the portion of the opening portion 28 that is at the side of the ceiling portion 26 opposite the end surface of the sidewall, i.e. at the side of the upper edge of the opening portion 28. The surface of the partition plate 29 is positioned at the side of the receiving portion 27 rather than at the side of the surface of the sidewalls 25*a*. The partition plate 29 comes into contact with the shaft portion 41, and pivotably holds the pull tab 12. In addition, slider-side regulating portions 30 which will be described later are formed forward of the front wall (circumferential wall) of the opening portion 28.

In addition, as for assembly of the slider 10 for a slide fastener, the shaft portion 41 of the pull tab 12 is inserted into the concave recess 22, the stopper hook 13 is disposed in the slider body 14 such that it surrounds the shaft portion 41 from above, and the cover body 15 is put on the pull tab 12 and the stopper hook 13 such that the shaft portion 41 of the pull tab 12 and the entire portions of the stopper hook 13 are covered. In addition, the cover body 15 is crimped and fixed to the recesses 20*a* and 21*a* of the front and rear attachment posts 20 and 21 in response to crimping portions 25*d* in the front and rear portions of the sidewalls 25*a* being pressed inward in the width direction. Consequently, the pull tab 12 is attached to the slider main body 11 so as to be pivotable about the shaft portion 41.

Figure 2:
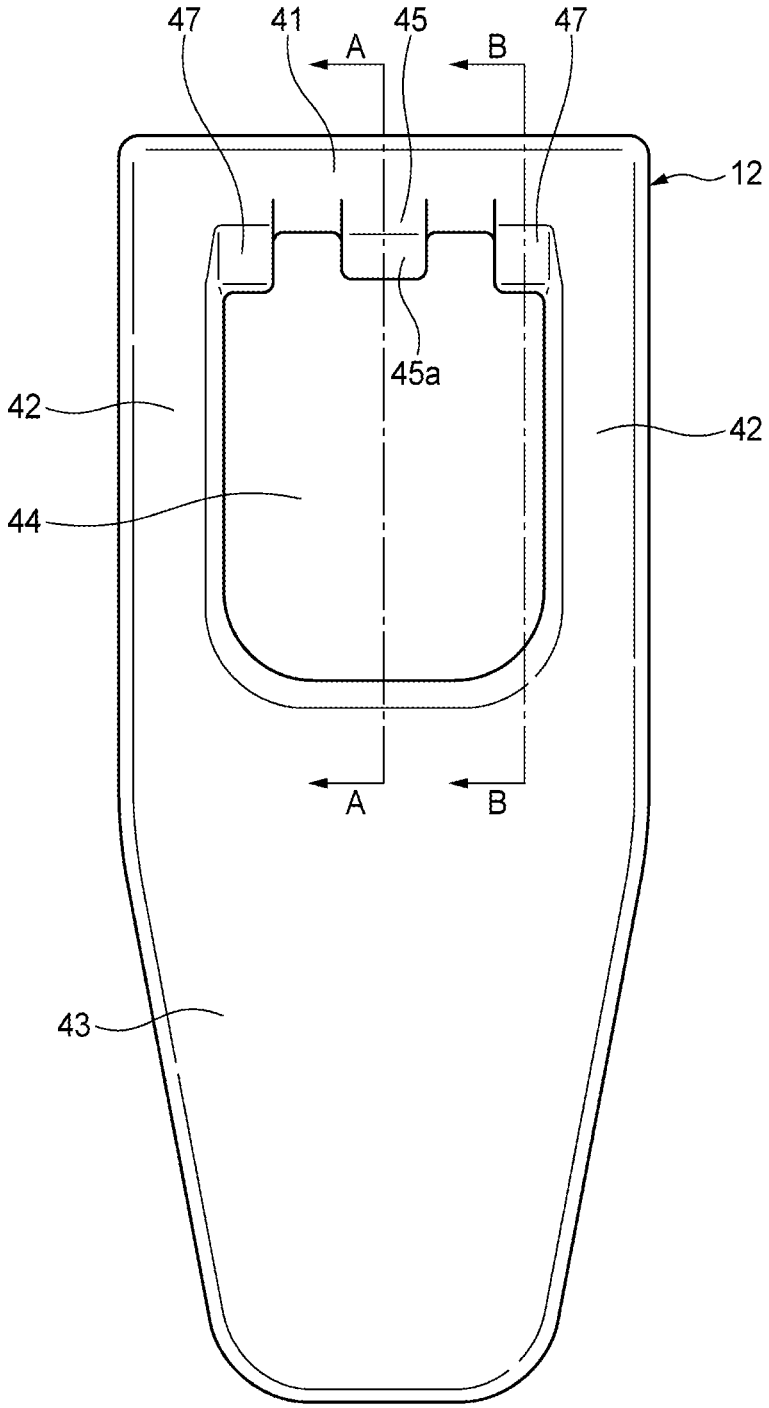
FIG. 2 is a top plan view of the pull tab shown in FIG. 1.
Figure 3:
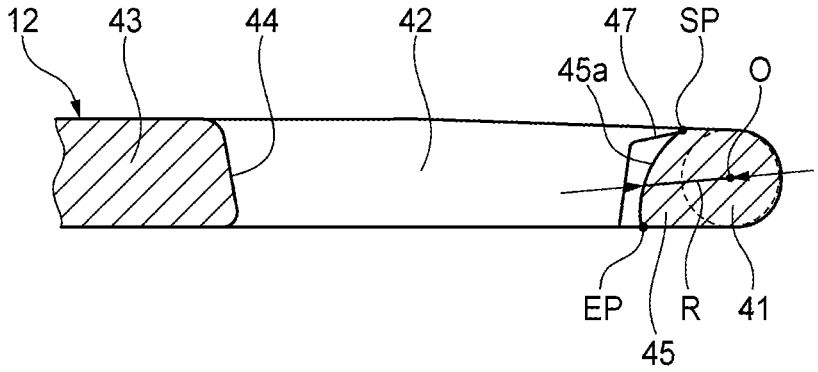
FIG. 3 is a cross-sectional view of the pull tab shown in FIG. 2, taken along line A-A.
Figure 4:
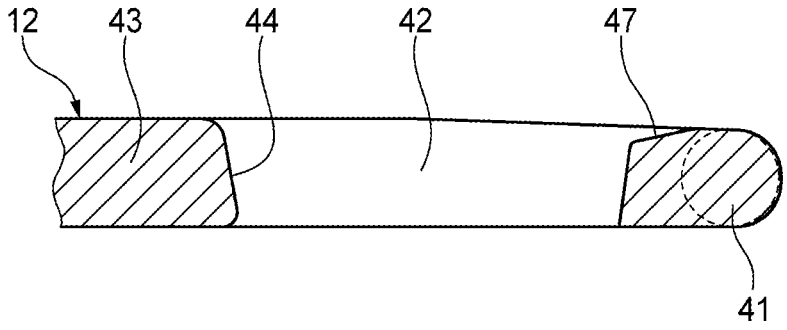
FIG. 4 is a cross-sectional view of the pull tab shown in FIG. 2, taken along line B-B.

As shown in FIG. 2 to FIG. 4, the pull tab 12 has the shaft portion 41, a pair of connecting rods 42 each having one end connected to the shaft portion 41, and a knob portion 43 which is connected to the other end of each of the pair of connecting rods 42. The shaft portion 41, the pair of connecting rods 42 and the knob portion 43 define a substantially rectangular pull tab opening portion 44.

In addition, a cam portion 45 is formed in the axial central portion of the shaft portion 41, and extends toward the pull tab opening portion 44. The cam portion 45 has a cam surface 45*a*, which is formed such that the distance R from the center of axis O of the shaft portion 41 gradually increases from the upper surface side which is the starting point SP to the undersurface side which is the end point EP. In addition, the cam surface 45*a* cooperates with a spring portion 32 which will be described later to urge the pull tab 12 in the direction in which the pull tab 12 returns to the lay-down state.

In addition, as shown in FIG. 2 and FIG. 4, pull tab-side regulating portions 47 are formed at both sides of the camp portion 45, and extend toward the pull tab opening portion 44 from inner corner portions which come into contact with the pull tab opening portion 44 and in which the shaft portion 41 and the connecting rods 42 are connected to each other. The pull tab-side regulating portions 47 form regulating portions together with the slider-side regulating portions 30. When pull tab-side regulating portions 47 abut against the slider-side regulating portions 30, the pull tab 12 is prevented from excessively pivoting.

The above-described pull tab 12 is located at a position where the cam portion 45 can come into contact with the spring portion 32 which will be described later, is located at a position where the pull tab-side regulating portions 47 can come into contact with the slider-side regulating portions 30, and is held in the slider body 14 by the cover body 15 such that the partition plate 29 enters the shaft portion 41 between the cam portion 45 and the slider-side regulating portions 30.

The stopper hook 13 is made of a metal material, for example, a copper alloy, a stainless steel or the like, and as shown in FIG. 1, is formed as an integral member with the spring portion 32. The stopper hook 13 is comprised of a hook portion 13*a* which is formed at the leading end and one first leg portion 13*b* which is bent from the hook portion 13*a* toward the upper right in the figure and extends to have a substantially V shape as a whole. The spring portion 32 has a pair of second legs 32*a* and 32*b* which is diverged from the hook portion 31*a* so as to be separated from the first leg portion 13*b*, is more bent than the first leg portion 13*b*, and extends from both sides of the first leg 13*b*. The second leg portions 32*a* and 32*b* extend in a lower position than the first leg portion 13*b*. The leading ends of the second leg portions 32*a* and 32*b* is bent downward, and the second leg portions 32*a* and 32*b* are connected to each other at the leading ends.

The hook portion 13*a* of the stopper hook 13 is inserted into the hook hole 35 of the slider body 14, and can protrude from and retract into the element guide path 24. In addition, the first leg portion 13*b* abuts against the rear surface of the ceiling portion 26 of the cover body 15 in the state in which the leading end thereof is inserted into the guide recess 26*a* (see FIG. 6). In addition, when the pull tab 12 is pulled (erected state), the hook portion 13*a* escapes from the element guide path 24, thereby allowing the slider 10 to move. When the pull tab 12 has lay down (lay-down state), the hook portion 13*a* dashes between fastener elements (not shown) which are present inside the element guide path 24 while dashing into the element guide path 24, thereby obstructing the slider 10 from moving.

The leading end side of an opening portion that is defined by the pair of second leg portions 32*a* and 32*b*, which is the spring portion 32, is wide open having the shape of a square, and is fitted on and engages with a protrusion 20*b* which is formed on the central portion of the front-side end, which is the upper surface of the front attachment post 20. The spring portion 32 presses the cam portion 45 toward the upper surface of the upper blade 16 due to an elastic force that is generated between the spring portion 32 and the first leg portion 13*b* which is urged to the rear surface of the ceiling 26, thereby holding the lay-down state of the pull tab 12.

Figure 5:
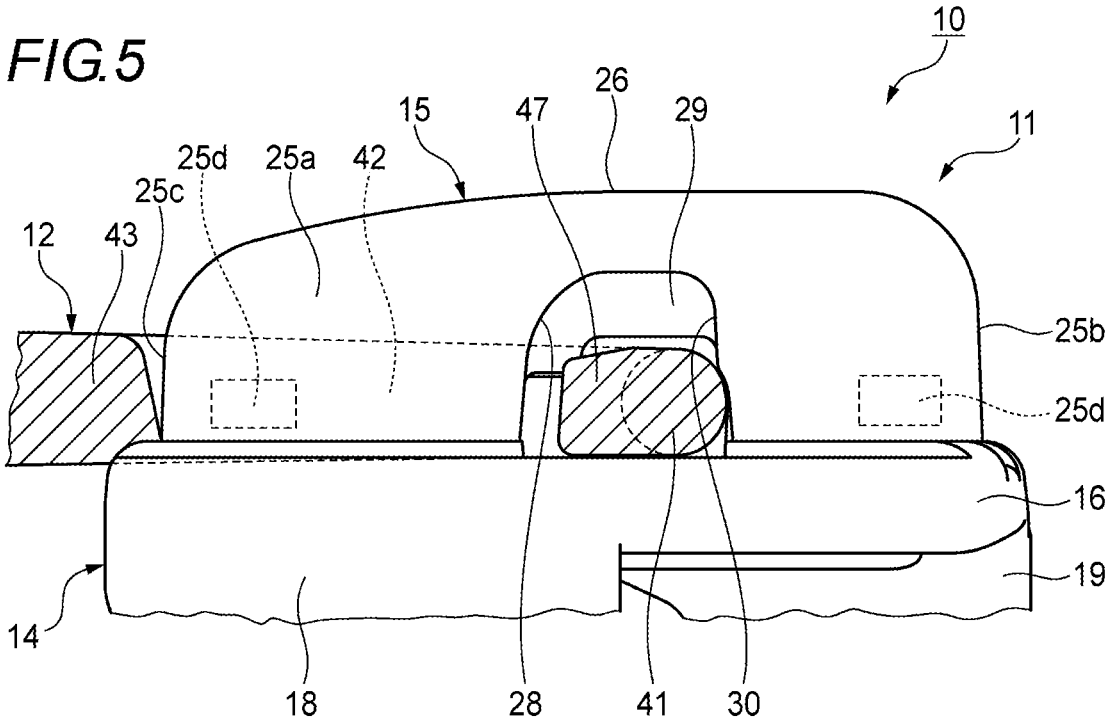
FIG. 5 is an enlarged side elevation view of the slider for a slide fastener when the pull tab is in a lay-down state.
Figure 6:
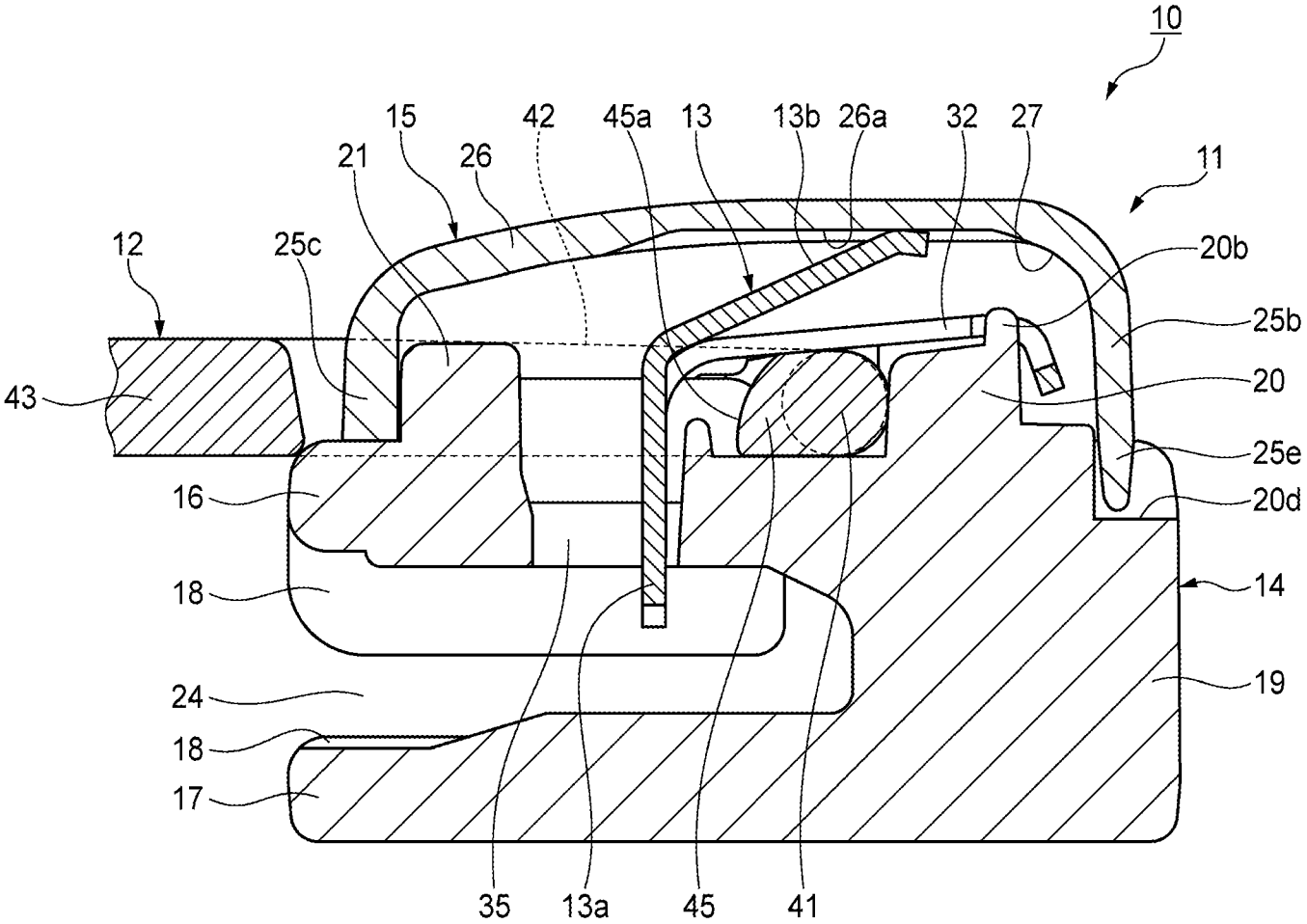
FIG. 6 is a longitudinal cross-sectional view of the slider for a slide fastener when the pull tab is in a lay-down state.

In addition, as shown in FIG. 5 and FIG. 6, in the lay-down state in which the pull tab 12 has lay down toward the rear mouth side, a portion of the cam portion 45 of the pull tab 12 enters the recess 23 of the slider body 14 so as to be received while the upper surface of the cam portion 45 is pressed toward the upper surface of the upper blade 16 by the spring portion 32. Consequently, the pull tab 12 is held in the lay-down state in which it is lay down toward the rear mouth side. In addition, at this time, the hook portion 13*a* of the stopper hook 13 rushes into the element guide path 24 through the hook hole 35 of the upper blade 16, thereby obstructing the slider 10 from moving.

Figure 7:
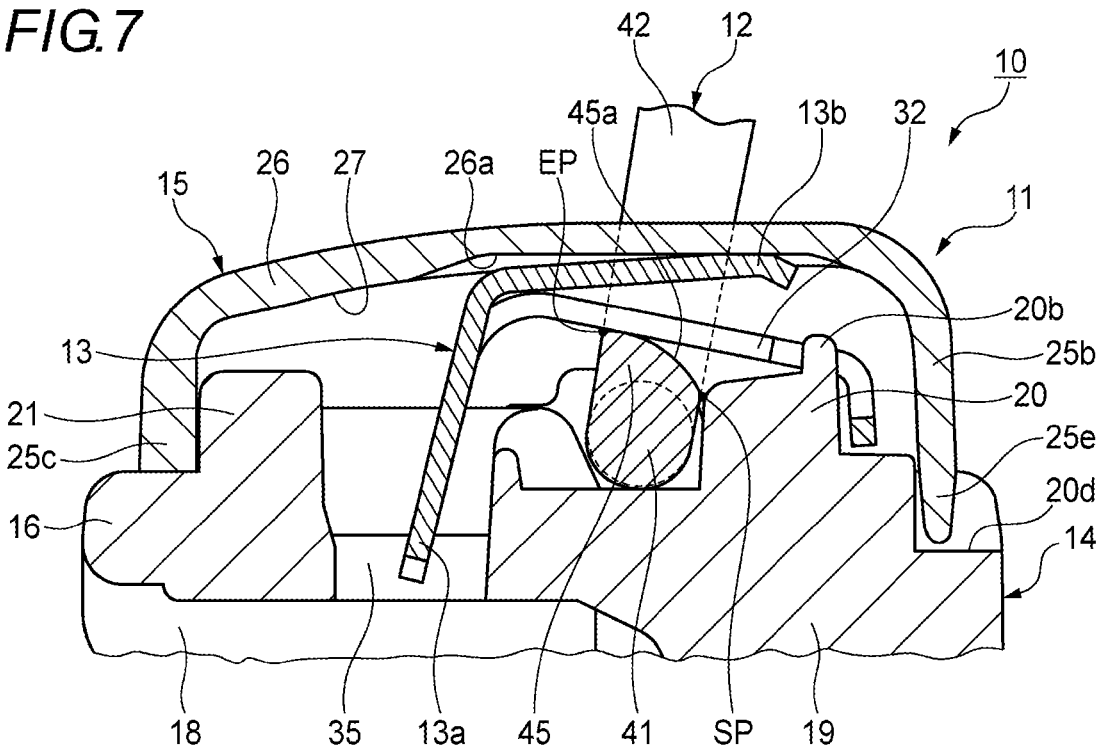
FIG. 7 is an enlarged longitudinal cross-sectional view of the slider for a slide fastener which shows the state in which the pull tab is urged toward a lay-down state by the elastic force of a spring section that occurs on a cam section when the pull tab is in an erected state.
Figure 8:
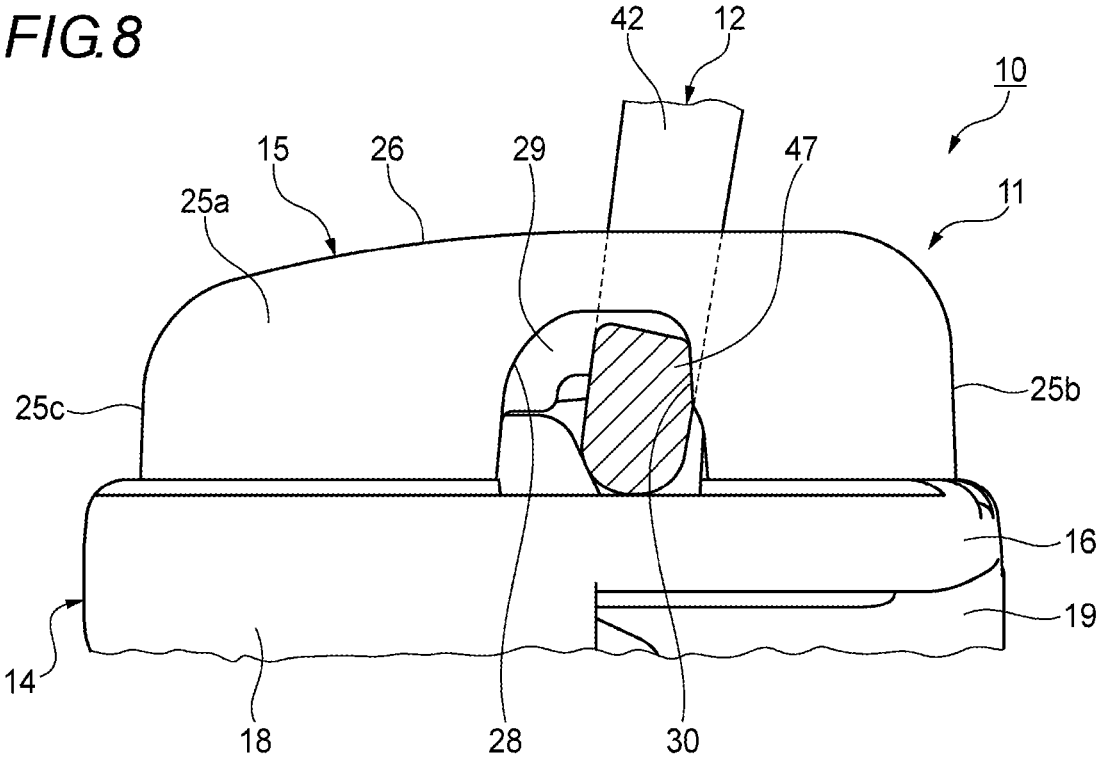
FIG. 8 is an enlarged side elevation view of the slider for a slide fastener showing the state in which the pull tab in the erected state is obstructed from pivoting by regulating portions.

In addition, as shown in FIG. 7 and FIG. 8, when the pull tab 12 in the lay-down state is operated so as to have the erected state by pivoting about the shaft portion 41 (the clockwise direction in FIG. 7), the spring portion 32 is pressed upward against the elastic force of the spring portion 32 by the cam surface 45*a* of the cam portion 45. Consequently, the hook portion 13*a* of the stopper hook 13 escapes from the element guide path 24, thereby allowing the slider 10 to move.

At this time, since the elastic force of the spring portion 32 is acting on the cam surface of the pull tab 12, the pull tab 12 is constantly urged to the position in which the pull tab 12 is initially lay down (the rear side according to this embodiment). Therefore, when the pull tab 12 is opened, the pull tab rotates counterclockwise from the erected state, thereby returning to the lay-down state where it is lay down toward the rear mouth side. Here, when the position where the spring portion 32 comes into contact with the cam surface 45*a* is beyond the end point EP of the cam surface 45*a*, the pull tab is lay down toward a side that is opposite the position where it is initially lay down, i.e. toward a shoulder mouth side, or is in the erected state without lying down in any direction. However, this embodiment has the regulating portions which obstruct the pull tab 12 from pivoting so that the position where the spring portion 32 comes into contact with the cam surface 45*a* is within the range from the starting point SP to the end point EP of the cam surface 45*a*. Therefore, even if it is attempted to pivot the pull tab 12 further in the clockwise direction from the erected state shown in FIG. 8, the pull tab-side regulating portions 47 of the pull tab 12 abut against the slider-side regulating portions 30, thereby obstructing the pull tab 12 from pivoting.

As described above, the slider 10 for a slide fastener according to this embodiment is provided with the spring portion 32, the cam portion 45 which urges the pull tab 12 in the direction in which the pull tab 12 returns to the lay-down state using the elastic force of the spring portion 32 when the pull tab 12 pivots from the lay-down state where the pull tab 12 is lay down toward the rear mouth side of the slider main body 11 to the erected state, and the pull tab-side regulating portions 47 and the slider-side regulating portions 30 which obstruct the pull tab 12 from further pivoting from the erected state. In order to obstruct the slider main body 11 from being lay down toward the other side, the pull tab 12 can constantly stay in the state where it is lay down toward the rear mouth side except when the pull tab 12 is being operated. In addition, it is possible to improve operability since it is possible to prevent the pull tab 12 from laying down toward the rear shoulder side. Furthermore, since the above-described functions are realized by a simple structure, it is possible to reduce the size and weight of the slider 10 and assemble the slider 10 using an automatic assembly apparatus.

In addition, in the slider 10 for a slide fastener according to this embodiment, the regulating portions include the pull tab-side regulating portions 47 which are formed on the pull tab 12 and the slider-side regulating portions 30 which are formed on the slider main body 11. Since the pull tab 12 is obstructed from pivoting further from the erected state when the pull tab-side regulating portions 47 and the slider-side regulating portions 30 abut against each other, it is possible to reliably prevent the pull tab 12 from excessively pivoting, thereby improving the operability of the slider 10.

In addition, in the slider 10 for a slide fastener according to this embodiment, since the regulating portions 47 are provided on the shaft portion 41 of the pull tab 12, it is possible to prevent the pull tab 12 from excessively pivoting without disposing any special regulating member.

In addition, in the slider 10 for a slide fastener according to this embodiment, the pull tab-side regulating portions 47 and the cam portion 45 extend toward the pull tab opening portion 44 which is defined by the shaft portion 41. Consequently, when the pull tab 12 is operated, the connecting rods 42 and the knob portion 43, neither the pull tab-side regulating portions 47 nor the cam portion 45 hinders the operation, so that the pull tab 12 can be easily operated.

In addition, in the slider 10 for a slide fastener according to this embodiment, the positions where the slider-side regulating portions 30 and the pull tab-side regulating portions 74 come into contact with the spring portion 32 and the cam portion 45 are within the range from the starting point SP to the end point EP of the cam surface 45*a* of the cam portion 45. Therefore, the position where the spring portion 32 comes into contact with the cam portion 45 is not beyond the cam surface 45*a*. It is therefore possible to reliably return the pull tab 12 to the lay-down state where the pull tab 12 is lay down toward the rear mouth side due to the elastic force of the spring portion 32 that acts on the cam surface 45*a*.

In addition, in the 10 for a slide fastener according to this embodiment, since the slider-side regulating portions 30 are formed on the front wall of the circumferential wall of the opening portion 28 of the cover body 15, it is possible to prevent the pull tab 12 from excessively pivoting without disposing any special regulating member.

In addition, in the 10 for a slide fastener according to this embodiment, the pull tab 12 is lay down toward the rear mouth side of the slider main body 11 in the lay-down state, the pull tab-side regulating portions 47 are formed at the side of the upper surface of the pull tab 12 in the lay-down state, and the slider-side regulating portions 30 are formed at positions that face the upper surface of the pull tab 12 when the pull tab 12 pivots toward the rear shoulder side of the slider main body 11. Therefore, at normal times, it is possible to maintain the pull tab 12 in the state in which the pull tab 12 is laid toward the rear mouth side, thereby improving the operability of the slider 10.

(First Modified Embodiment)

Figure 9:
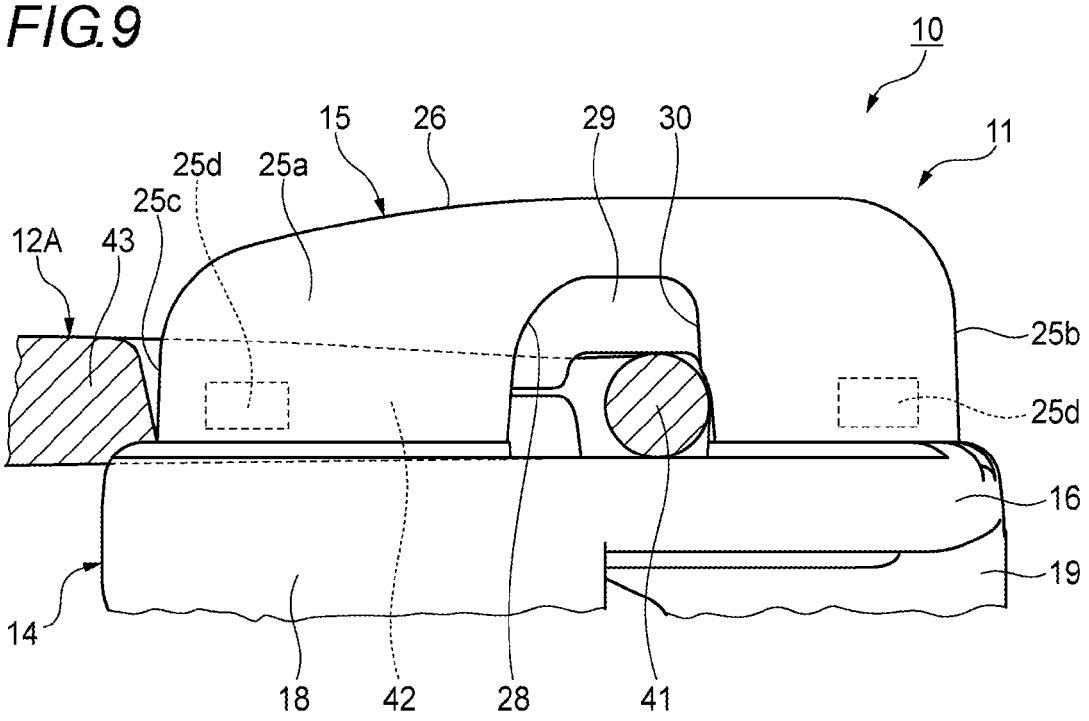
FIG. 9 is an enlarged side view showing a first modified embodiment of the slider for a slide fastener according to the first embodiment.
Figure 10:
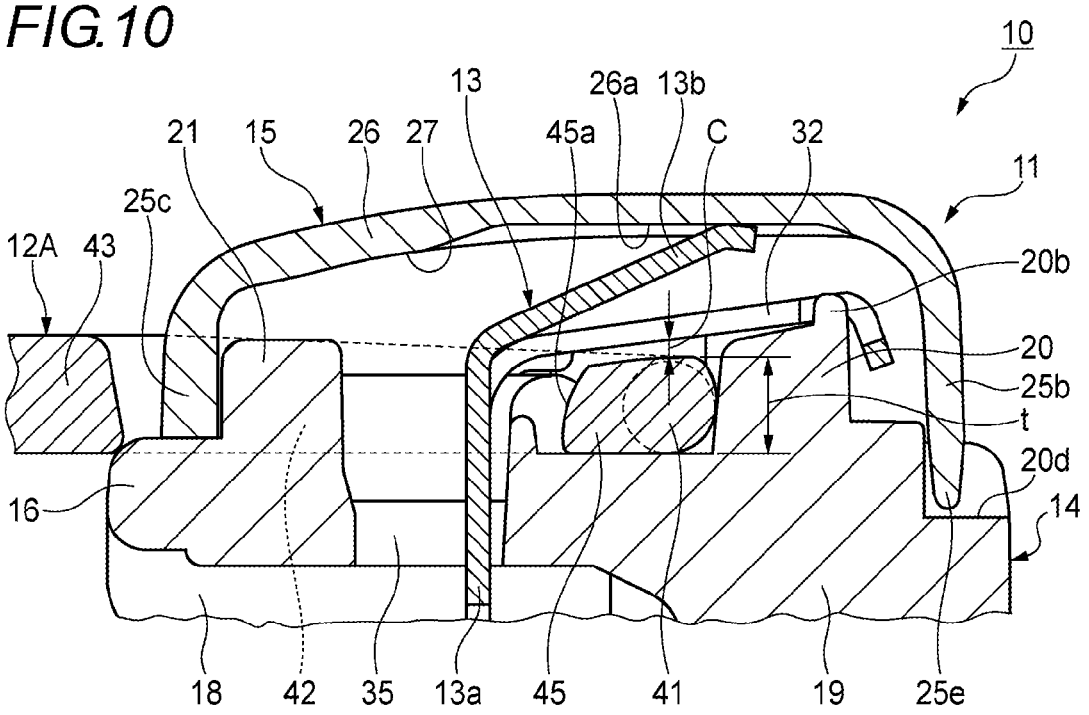
FIG. 10 is an enlarged longitudinal cross-sectional view of the slider for a slide fastener shown in FIG. 9.

As a first modified embodiment of this embodiment, the pull tab 12 may be configured as a pull tab 12A shown in FIG. 9 and FIG. 10. This pull tab 12A is configured such that the thickness t of the shaft portion 41 is smaller than the thickness of the shaft portion 41 of the pull tab 12. At the lay-down state of the pull tab 12A, an interval C is formed between the shaft portion 41 of the pull tab 12A and the spring portion 32. In other words, the pull tab 12A (shaft portion 41) is fitted to the concave recess 22 between the front and rear attachment posts 20 and 21 in the state in which it can play as much as this interval C. However, in this modified embodiment, the partition plate 29 of the cover body 15 comes into contact with the shaft portion 41 or extends downward such that the interval between the shaft portion 41 and the partition plate 29 is substantially 0, thereby preventing the shaft portion 41 from playing. That is, the present invention does not necessarily require that the pull tab 12 be pressed by the spring portion 32, but may be configured such that the pull tab 12 stays free and maintains the lay-down state.

(Second Modified Embodiment)

Figure 11:
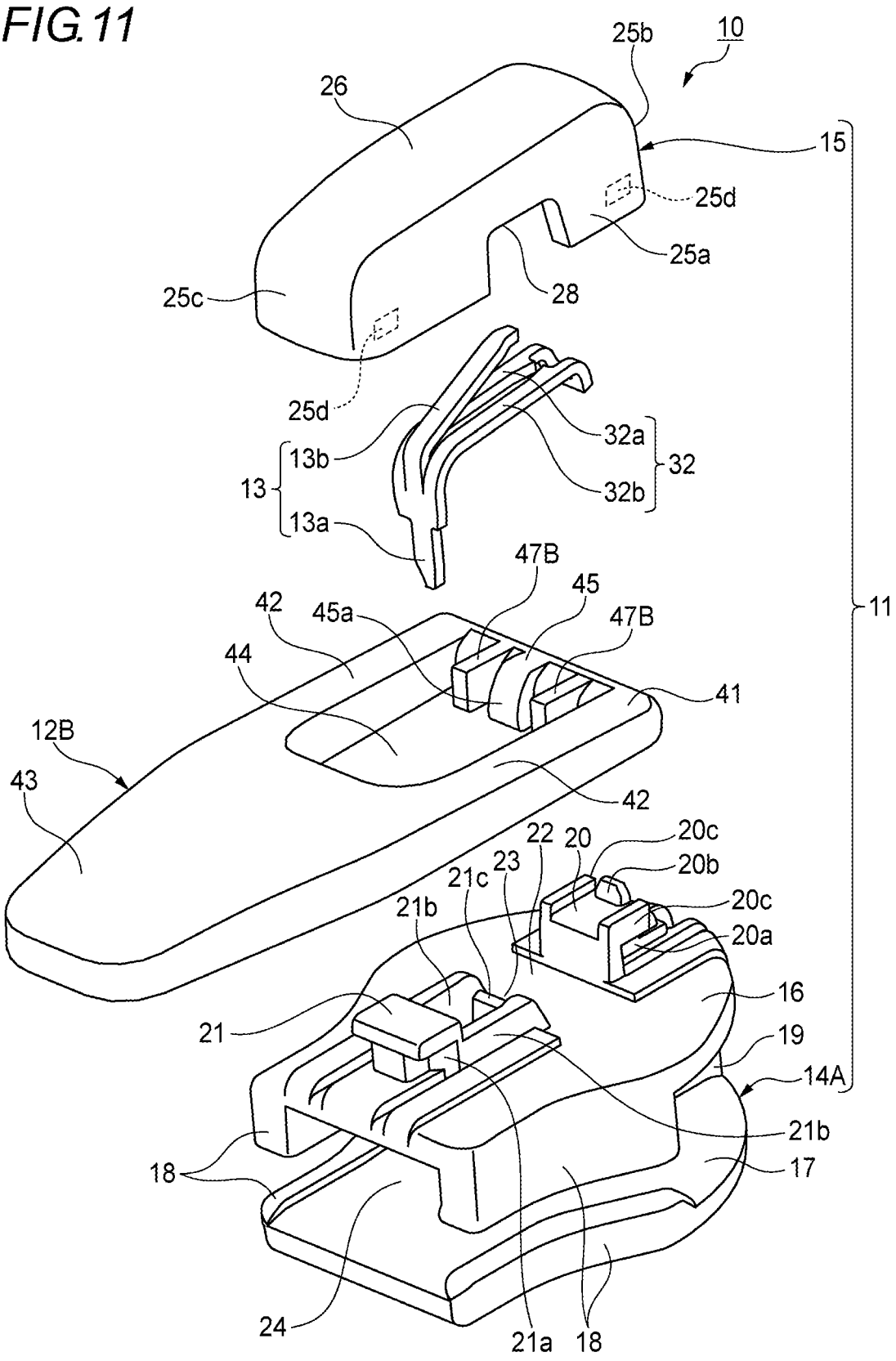
FIG. 11 is an exploded perspective view showing a second modified embodiment of the slider for a slide fastener according to the first embodiment of the invention.
Figure 12:
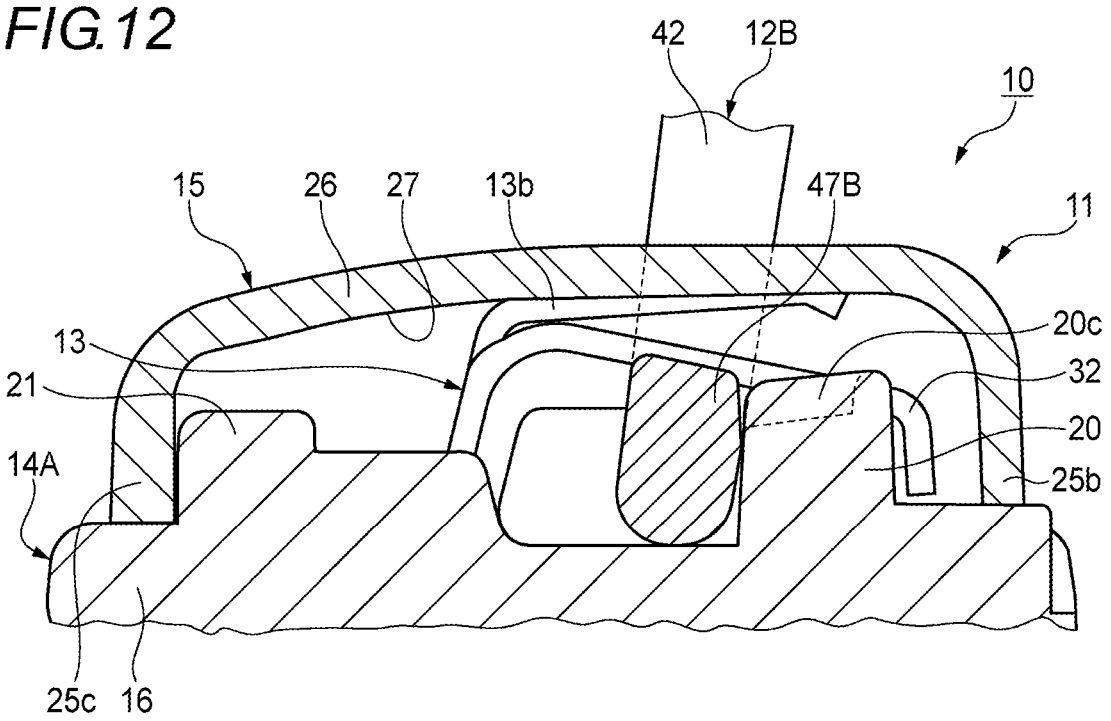
FIG. 12 is an enlarged longitudinal cross-sectional view of the slider for a slide fastener shown in FIG. 11.

As a second modified embodiment of this embodiment, the pull tab 12 and the slider body 14 may be configured as a pull tab 12B and a slider body 14A shown in FIG. 11 and FIG. 12. In this pull tab 12B, pull tab-side regulating portions 47B are formed at positions where they are spaced apart from the connecting rods 42 of the shaft portion 41. In addition, the slider body 14A has convex slider-side regulating portions 20*c* along the left and right circumference of the upper surface of the front attachment post 20 thereof.

In addition, according to this modified embodiment, as shown in FIG. 12, when the pull tab 12B pivots from the lay-down state into the erected state, the pull tab-side regulating portions 47B of the pull tab 12B abut against the slider-side regulating portions 20*c* of the slider body 14A, thereby preventing the pull tab 12B from excessively pivoting. That is, the positions of the regulating portions of the present invention are not limited. The pull tab-side regulating portions are formed on portions of the pull tab, preferably, on the shaft portion of the pull tab, whereas the slider-side regulating portions are preferably formed on portions of the slider main body, which may be on the cover body or on the slide body.

(Second Embodiment)

In sequence, with reference to FIG. 13 and FIG. 14, a description will be given of a second embodiment of the slider for a slide fastener according to the invention. In addition, the same reference numerals and signs will be used in the drawings in order to designate some components when they are the same as or like those of the first embodiment, and descriptions of those components will be omitted or simplified.

Figure 13:
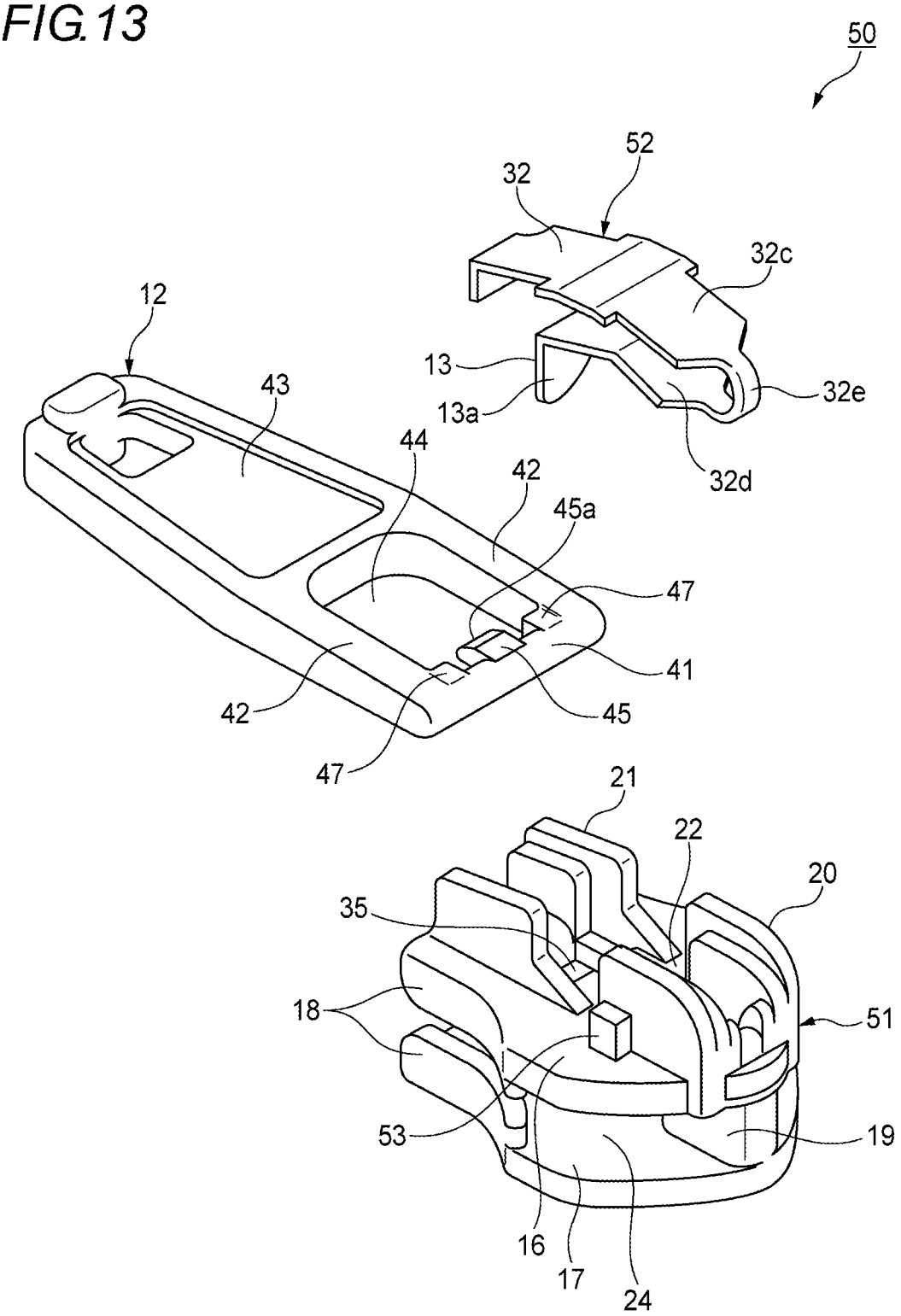
FIG. 13 is an exploded perspective view showing a second embodiment of the slider for a slide fastener according to the invention.
Figure 14:
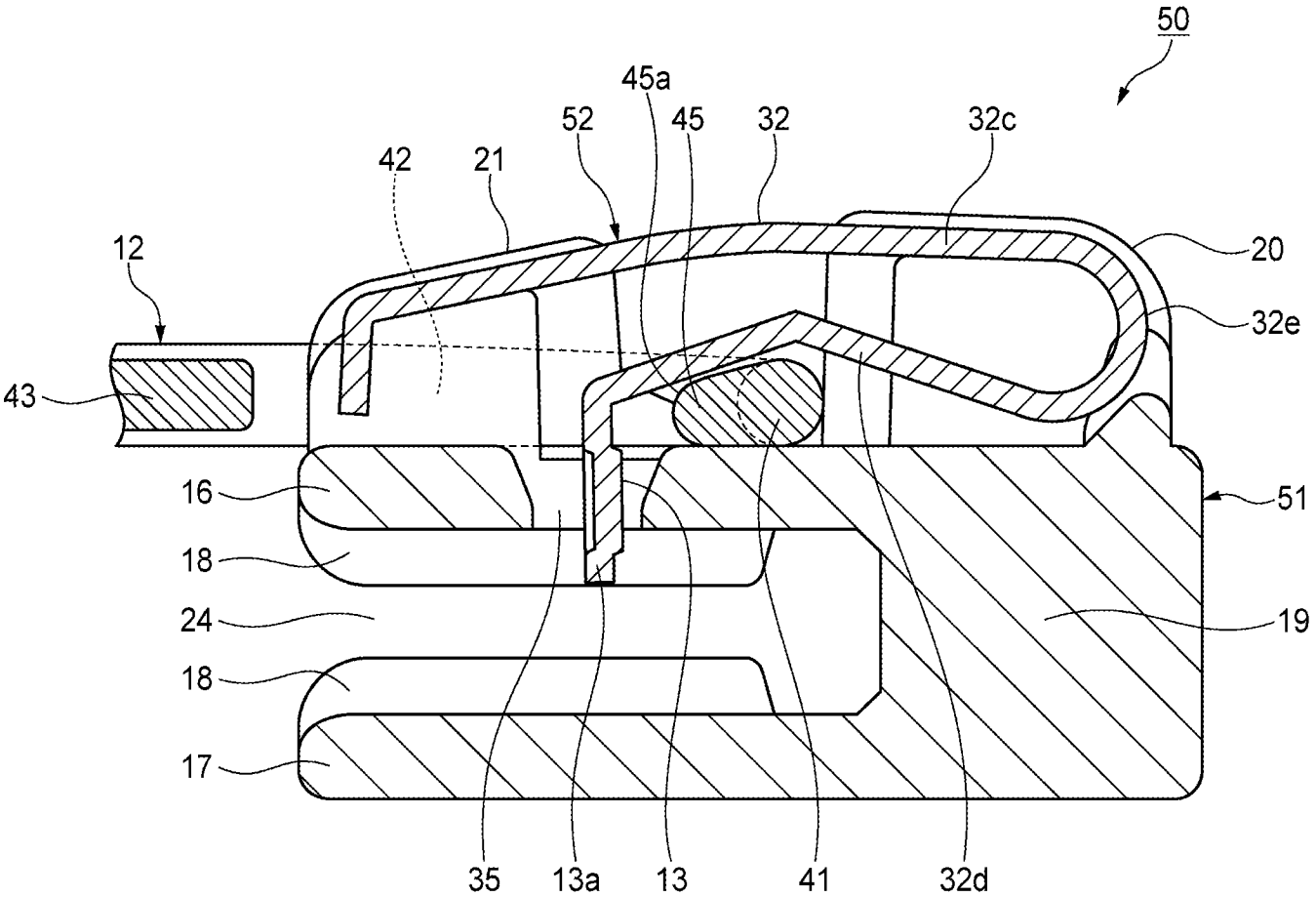
FIG. 14 is a longitudinal cross-sectional view of the slider for a slide fastener shown in FIG. 13.

As shown in FIG. 13 and FIG. 14, a slider 50 for a slide fastener according to this embodiment includes a slider main body 51, a pull tab 12, and a leaf spring 52 which integrally has a stopper hook 13 and a spring portion 32.

The slider main body 51 includes an upper blade 16 and a low blade 17 which are spaced apart from each other in the up-down direction and are arranged side by side, a pair of left and right flanges 18 which are provided along the left and right circumferences of the two blades 16 and 17, a guide post 19 which connects the upper and low blades 16 and 17 to each other at the width-directional central portions, a pair of front and rear attachment posts 20 and 21 which are respectively erected on the upper surface of the upper blade 16. In addition, in the state in which the shaft portion 41 of the pull tab 12 is inserted into the concave recess 22, when the leaf spring 52 is attached to the front attachment post 20 and the rear attachment post 21, the front attachment post 20, the rear attachment post 21 and the leaf spring 52 form a pull tab attachment portion. In addition, in this embodiment, slider-side regulating portions 53 are respectively erected on the upper surface of the upper blade 16, adjacent to both the left and right surfaces of the front attachment post 20.

The leaf spring 52 is formed by bending one sheet of a plate member such that it becomes substantially U-shaped. The stopper hook 13 is provided on the leading end of the spring portion 32, and a hook portion 13*a* is provided on the leading end of the stopper hook 13. In addition, the leaf spring 52 is crimped and fixed to the pair of front and rear attachment posts 20 and 21.

The spring portion 32 has an upper spring portion 32*c* and a lower spring portion 32*d* which are formed having a substantially U-shaped folding portion 32*e* as a boundary. In addition, the lower spring portion 32*d* is formed in a substantially V-shape at the middle portion thereof, abuts against the upper surface of the cam portion 45 of the pull tab 12, and presses the cam portion 45 downward. Consequently, the pull tab 12 is urged by the elastic force of the spring portion 32 that acts on the cam portion 45 so that the pull tab 12 pivots counterclockwise in FIG. 14.

In the slider 50 which is configured as above, since the elastic force of the spring portion 32 constantly acts on the cam portion 45 of the pull tab 12, thereby urging the pull tab 12 counterclockwise in FIG. 14, the pull tab 12 stays in the lay-down state where it is lay down toward the rear mouth side. In addition, at this time, the hook portion 13*a* of the stopper hook 13 rushes into the element guide 24 through the hook hole 35 of the upper blade 16, thereby obstructing the slider 50 from moving.

When the pull tab 12 is operated so as to pivot from the lay-down state to the erected state, the lower spring portion 32*d* is pushed upward by the cam surface 45*a* of the cam portion 45. Consequently, the hook portion 13*a* of the stopper hook 13 escapes from the element guide path 24, thereby allowing the slider 50 to move.

At this time, since the elastic force of the spring portion 32 is acting on the cam surface 45*a* of the pull tab 12, the pull tab 12 is urged counterclockwise in FIG. 14. Consequently, when the pull tab 12 is opened, the pull tab 12 pivots counterclockwise from the erected state and returns to the lay-down state where it is lay down toward the rear mouth side. In addition, when it is attempted to pivot the pull tab 12 further in the clockwise direction, pull tab-side regulating portions 47 of the pull tab 12 abut against the slider-side regulating portions 53, thereby obstructing the pull tab 12 from pivoting.

The other construction and operational effects are the same as those of the first embodiment as described above.

That is, the slider according to the invention not only consists of four parts including the cover body, the slider body, the pull tab and the stopper hook, but also can consist of three parts including, for example, the slider main body 51, the pull tab 12, and the leaf spring 52 which is used as the cover body, the stopper hook and the spring portion.

(Third Embodiment)

In sequence, with reference to FIG. 15 and FIG. 16, a description will be given of a third embodiment of the slider for a slide fastener according to the invention. In addition, the same reference numerals and signs will be used in the drawings in order to designate some components when they are the same as or like those of the first embodiment, and descriptions of those components will be omitted or simplified.

Figure 15:
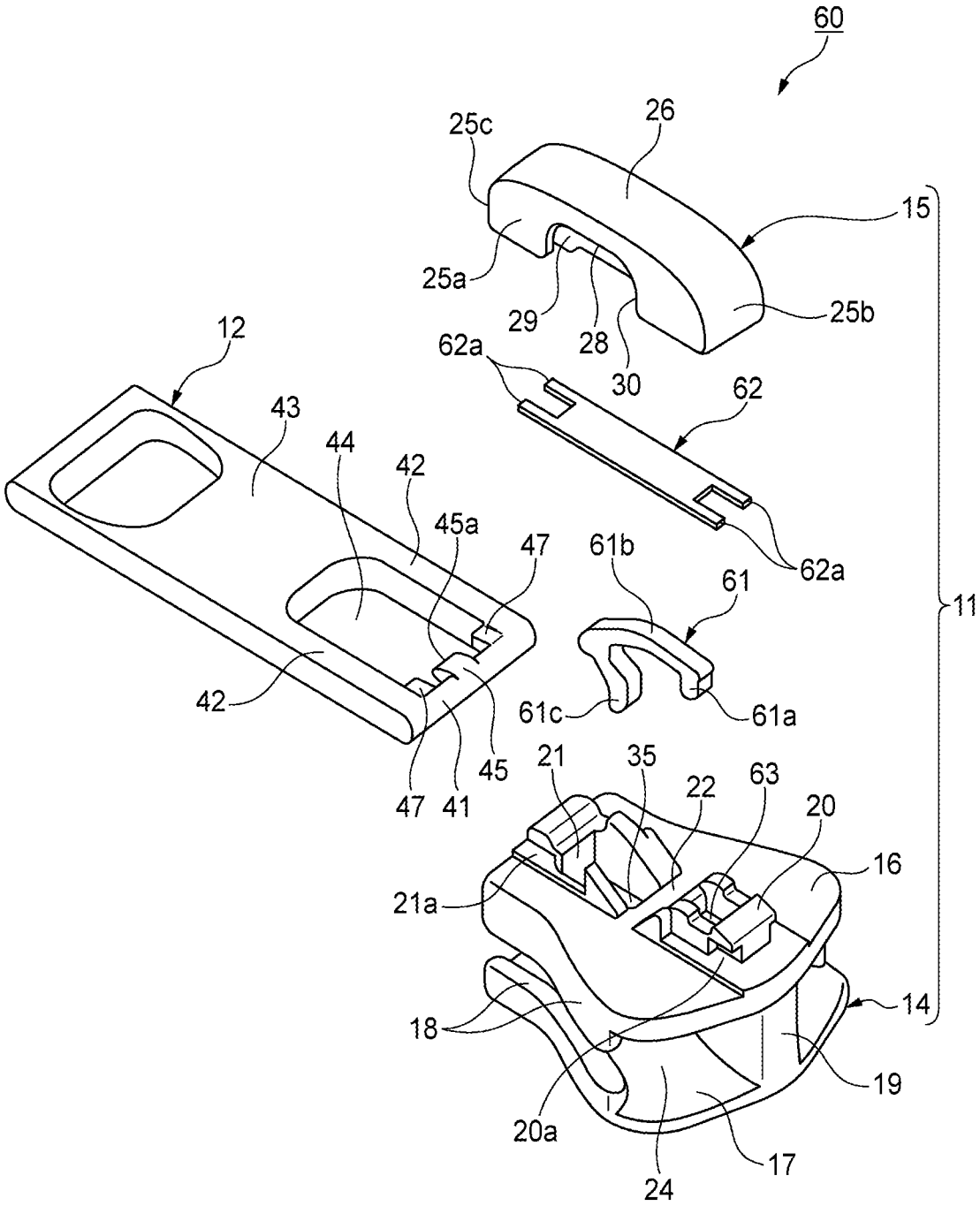
FIG. 15 is an exploded perspective view showing a third embodiment of the slider for a slide fastener according to the invention.
Figure 16:
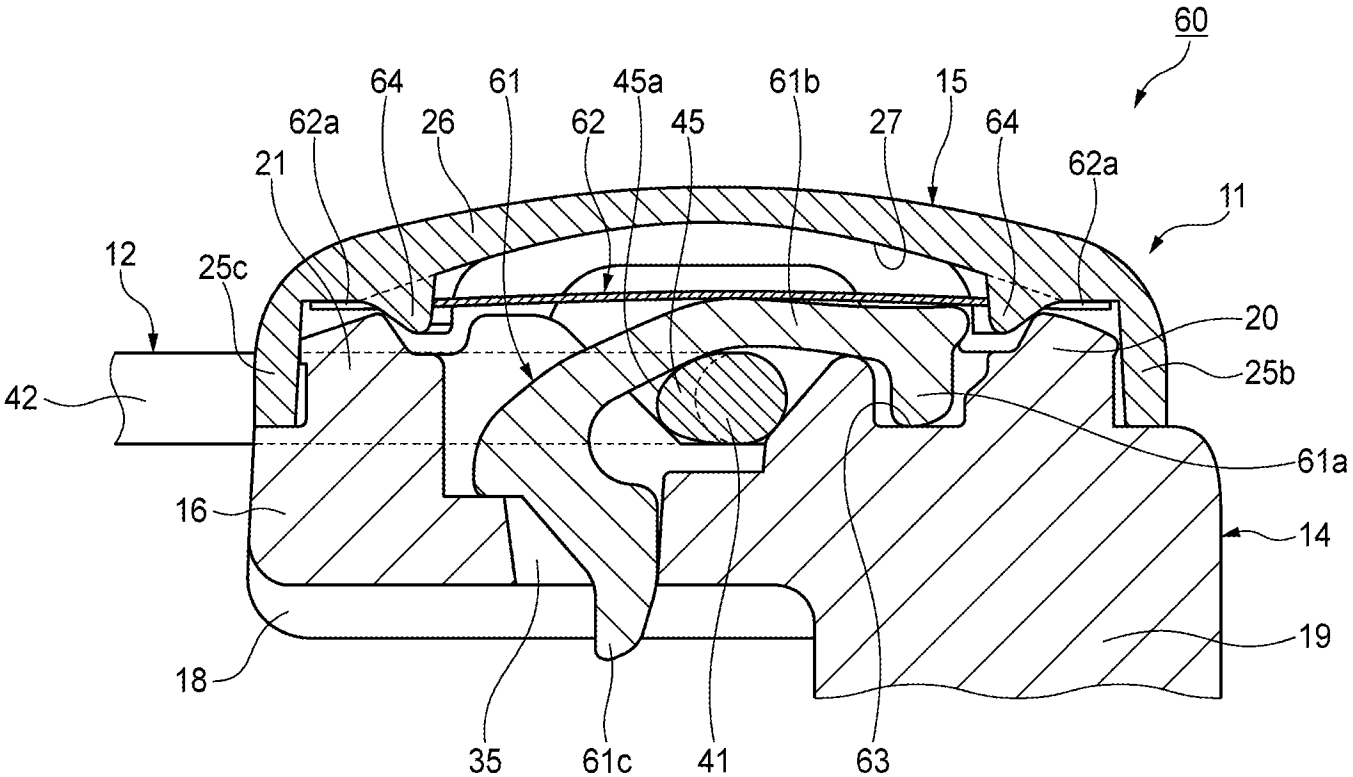
FIG. 16 is an enlarged longitudinal cross-sectional view of the slider for a slide fastener shown in FIG. 15.

As shown in FIG. 15 and FIG. 16, a slider 60 for a slide fastener according to this embodiment includes a slider main body 11, a pull tab 12, a stopper hook 61, and a leaf spring 62 which is a spring portion.

The stopper hook 61 has an engagement base portion 61*a* which engages with a front attachment post 20 of a slider body 14, a body portion 61*b* which extends backward from the engagement base 61*a* and to which an elastic force of the leaf spring 62 acts from above, and a hook portion 61*c* which extends downward from the rear end of the body portion 61*b*. In addition, an engagement recess 63 which engages with the engagement base 61*a* is formed in the upper surface of the front attachment post 20. In addition, in the state in which the shaft portion 41 of the pull tab 12 is inserted into a concave recess 22, when a cover body 15 is attached to the front attachment post 20 and a rear attachment post 21, the front attachment post 20, the rear attachment post 21 and the cover body 15 form a pull tab attachment portion.

The leaf spring 62 is a plate-shaped member which is disposed above the stopper hook and is substantially rectangular. A pair of protrusions 62*a* which engage with the cover body 15 are respectively formed on both lengthwise end portions of the leaf spring 62. In addition, engagement convex portions 64 which engage with the pair of protrusions 62*a* are respectively formed on the inner surface of the ceiling 26 of the cover body 15. In addition, the leaf spring 62 abuts against the upper surface of the body portion 61*b* of the stopper hook 61, and presses the cam portion 45 of the pull tab 12 downward through the stopper hook 61. Consequently, the pull tab 12 is urged by the elastic force of the leaf spring 62 that acts on the cam portion 45 of the stopper hook 61 so that the pull tab 12 pivots counterclockwise in FIG. 16.

In the slider 60 constructed as above, the elastic force of the leaf spring 62 constantly acts on the cam portion 45 of the pull tab 12, thereby urging the pull tab 12 counterclockwise in FIG. 16. Consequently, the pull tab 12 stays in the lay-down state where it is lay down toward the rear mouth side. In addition, at this time, the hook portion 61*c* of the stopper hook 61 rushes into an element guide path 24 through a hook hole 35 of the upper blade 16, thereby obstructing the slider 60 from moving. Furthermore, due to the elastic force of the leaf spring 62 that is transmitted through the stopper hook 61, the shaft portion 41 of the pull tab 12 comes into contact with the upper portion of the concave recess 22, i.e. a portion of the upper blade 16 between the front and rear attachment posts 20 and 21, and thus stays without playing.

When the pull tab 12 is operated so as to pivot from the lay-down state into the erected state, the stopper hook 61 is pushed upward against the elastic force of the leaf spring 62 by the cam surface 45*a* of the cam portion 45. Consequently, the hook portion 61*c* of the stopper hook 61 escapes from the element guide path 24, thereby allowing the slider to move.

At this time, since the elastic force of the leaf spring 62 is acting on the cam surface 45*a* of the pull tab 12, the pull tab 12 is urged counterclockwise in FIG. 16. Consequently, when the pull tab 12 is opened, the pull tab 12 pivots counterclockwise from the erected state and returns to the lay-down state where it is laid toward the rear mouth side. In addition, when it is attempted to pivot the pull tab 12 further from the erected state, pull tab-side regulating portions 47 of the pull tab 12 abut against slider-side regulating portions 30 of the cover body 15, thereby obstructing the pull tab 12 from pivoting.

The other construction and operational effects are the same as those of the first embodiment as described above.

That is, the slider according to the invention may be configured such that not only the spring portion is integrally formed in the stopper hook but also the stopper hook and the spring portion are provided as separate pieces.

(Fourth Embodiment)

In sequence, with reference to FIG. 17 and FIG. 18, a description will be given of a fourth embodiment of the slider for a slide fastener according to the invention. In addition, the same reference numerals and signs will be used in the drawings in order to designate some components when they are the same as or like those of the first embodiment, and descriptions of those components will be omitted or simplified.

Figure 17:
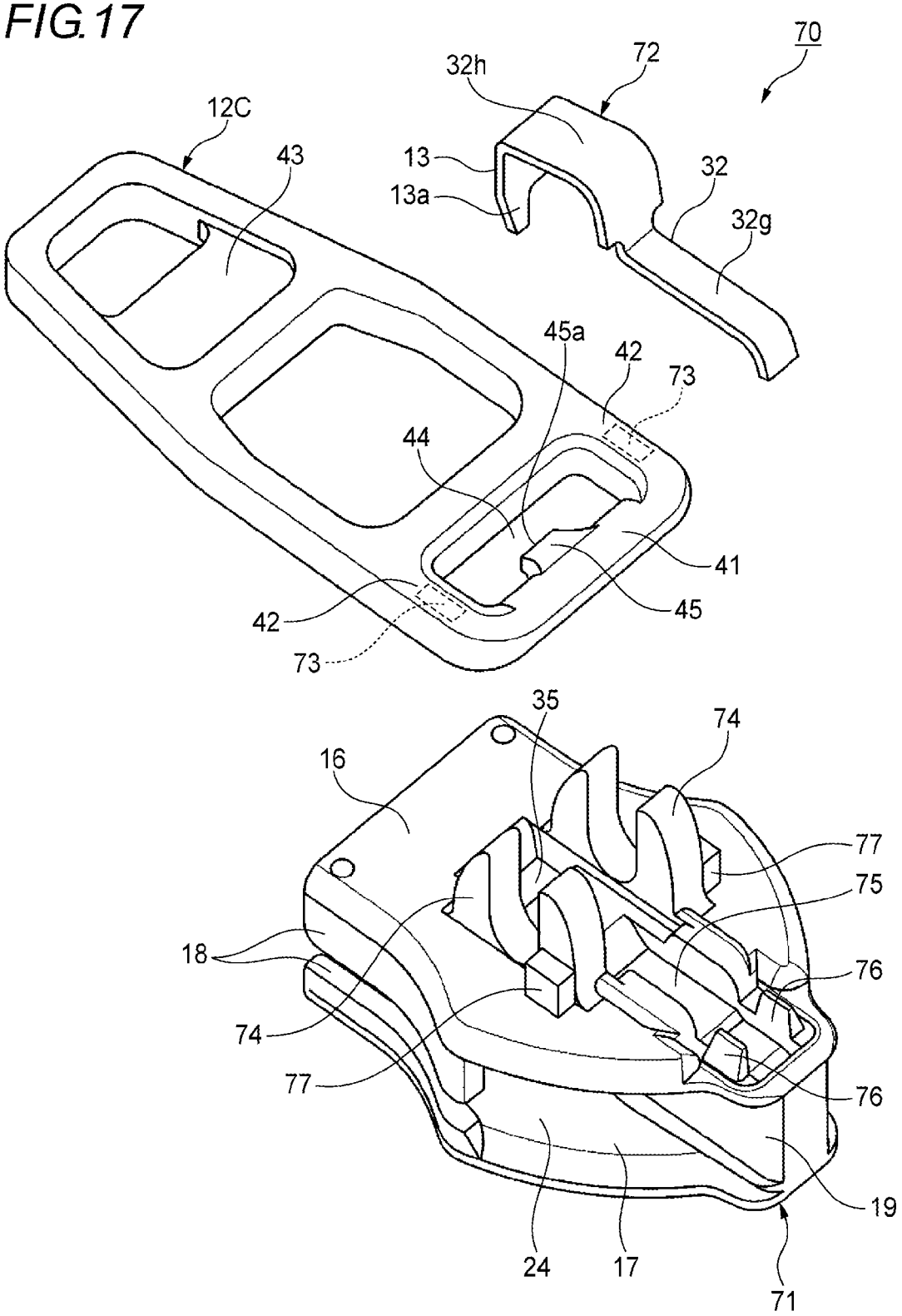
FIG. 17 is an exploded perspective view showing a fourth embodiment of the slider for a slide fastener according to the invention.
Figure 18:
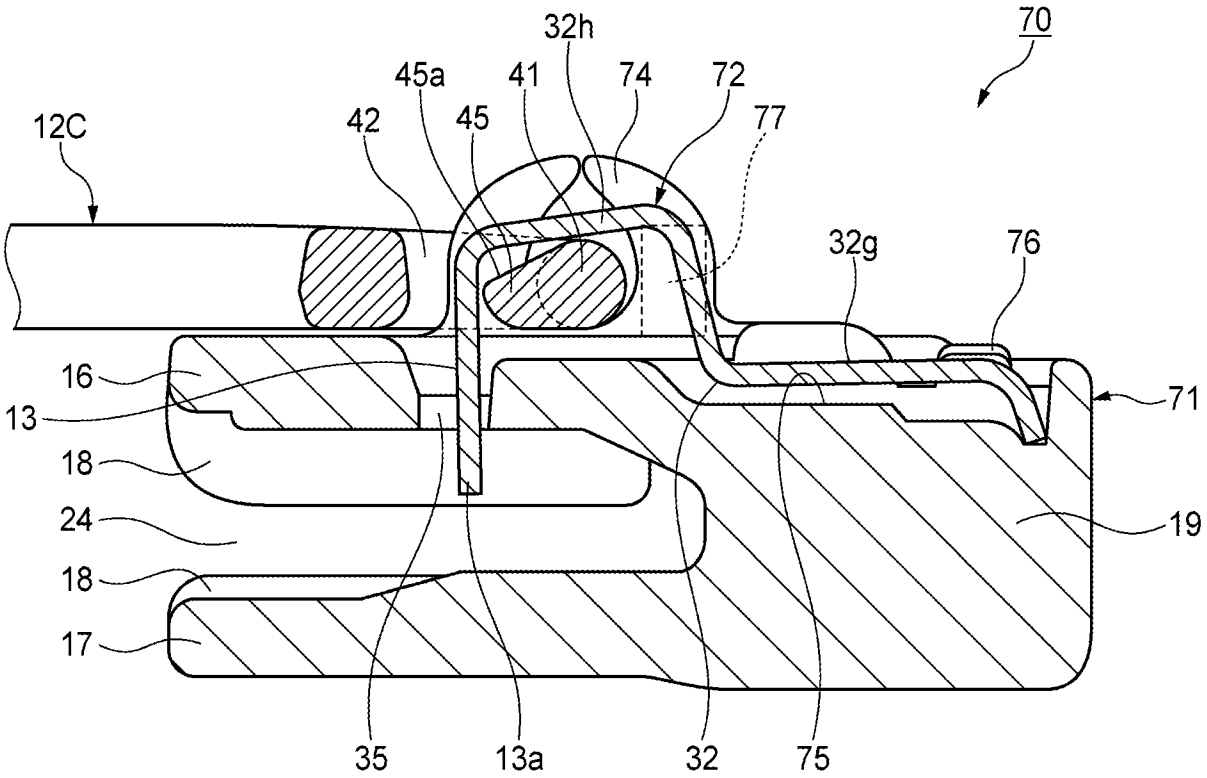
FIG. 18 is a longitudinal cross-sectional view of the slider for a slide fastener shown in FIG. 17.

As shown in FIG. 17 and FIG. 18, a slider 70 for a slide fastener according to this embodiment includes a slider main body 71, a pull tab 12C, and a leaf spring 72 which integrally has a stopper hook 13 and a spring portion 32.

The pull tab 12C has a shaft portion 41, a pair of connecting rods 42 and a knob portion 43. In the axial central portion of the shaft portion 41, a cam portion 45 extends toward a pull tab opening portion 44. In addition, according to this embodiment, pull tab-side regulating portions 73 are formed on a pair of connecting rods 42.

The slider main body 71 includes an upper blade 16 and a low blade 17 which are spaced apart from each other in the up-down direction and are arranged side by side, a pair of left and right flanges 18 which are formed along the left and right circumferences of the two blades 16 and 17, a guide post 19 which connects the two blades 16 and 17 to each other at the width-directional central portions, a pair of left and right pull tab attachment posts 74 serving as pull tab attachment portions which are erected on the upper surface of the upper blade 16 and pivotably hold the shaft portion 41 of the pull tab 12C, a receiving recess 75 which holds the leaf spring 72, and a pair of crimping portions 76 which are erected on the leading end of the receiving recess 75. In addition, according to this embodiment, slider-side regulating portions 77 are respectively erected on the upper surface of the upper blade 16, adjacent to the width-directional outer side surfaces of the pair of left and right pull tab attachment posts 74. In addition, as shown in FIG. 18, the pair of left and right pull tab attachment posts 74 are crimped in the front-back direction, thereby holding the pull tab 12C.

The leaf spring 72 is formed by bending one sheet of a plat member. The stopper hook 13 is provided on the leading end of the spring portion 32, and a hook portion 13*a* is provided on the leading end of the stopper hook 13. In addition, the leaf spring 72 is fixed to the slider main body 71 when the pair of crimping portions 76 of the slider main body 71 is crimped to the inside of the leaf spring 72.

The spring portion 32 has a substrate portion 32*g* which is received in the receiving recess 75 of the slider main body 71 and a cover portion 32*h* which extends upward from the rear end of the substrate 32*g* and extends backward. In addition, the cover portion 32*h* abuts against the upper surface of the cam portion 45 of the pull tab 12C, thereby pressing the cam portion 45 downward. Consequently, the pull tab 12C is urged by the elastic force of the spring portion 32 that acts on the cam portion 45 so that it pivots counterclockwise in FIG. 18.

In the slider 70 configured as above, the elastic force of the spring portion 32 constantly acts on the cam portion 45 of the pull tab 12C, thereby urging the pull tab 12C counterclockwise in FIG. 18. Consequently, the pull tab 12C stays in the lay-down state where it is laid toward the rear mouth side. In addition, at this time, the hook portion 13*a* of the stopper hook 13 rushes into the element guide path 24 through a hook hole 35 of the upper blade 16, thereby obstructing the slider 70 from moving.

When the pull tab 12C is operated so as to pivot from the lay-down state to the erected state, the cover portion 32*h* is pushed upward against the elastic force of the spring portion 32 by the cam surface 45*a* of the cam portion 45. Consequently, the hook portion 13*a* of the stopper hook 13 escapes from the element guide path 24, thereby allowing the slider 10 to move.

At this time, since the elastic force of the spring portion 32 is acting on the cam surface 45*a* of the pull tab 12C, the pull tab 12C is urged counterclockwise in FIG. 18. Consequently, when the pull tab 12C is opened, the pull tab 12C pivots counterclockwise from the erected state and returns to the lay-down state where it is lay down toward the rear mouth side. In addition, when it is attempted to pivot the pull tab 12C further in the clockwise direction, the pull tab-side regulating portions 73 (the connecting rods 42) of the pull tab 12C abut against the slider-side regulating portions 77, thereby obstructing the pull tab 12C from pivoting.

The other construction and operational effects are the same as those of the first embodiment as described above.

That is, the slider according to the invention may be configured such that the pull tab is not only pivotably supported to the slider main body by the front and rear attachment posts and cover body but also pivotably supported to the slider main body only by the pair of left and right pull tab attachment posts. In addition, the slider according to the invention may be configured such that not only the pull tab-side regulating portions are provided on the shaft portion of the pull tab but also the pull tab-side regulating portions are formed of portions of the connecting rods.

In addition, the slider according to the invention may be suitably changed in design within the scope of the disclosure of this application.

For example, in the above-described embodiments, although all of the cam portions 45 of the pull tab 12 are formed on the shaft portion 41, the cam surface may be formed on the shaft portion 41. The shaft portion 41 itself may be configured as a non-perfect circle having a curvature, such as an ellipse, a long circle, a circular triangle, a quadrangle or a pentagon.

DESCRIPTION OF REFERENCE NUMERALS

10 Slider For Slide Fastener
11 Slider Main Body
12, 12A, 12B, 12C Pull Tab
13 Stopper Hook
14, 14A Slider Body
15 Cover Body (Pull Tab Attachment Portion)
16 Upper Blade
20 Front Attachment Post (Pull Tab Attachment Portion)
20*c* Slider-Side Engagement Portion
21 Rear Attachment Post (Pull Tab Attachment Portion)
27 Receiving Portion
28 Opening Portion
29 Partition Plate
30 Slider-Side Regulating Portion
32 Spring Portion
41 Shaft Portion
42 Connecting Rod
43 Knob Portion
44 Pull Tab Opening Portion
45 Cam Portion
45*a* Cam Surface
47 Pull Tab-Side Regulating Portion
47B Pull Tab-Side Regulating Portion
50 Slider For Slide Fastener
51 Slider Main Body
52 Leaf Spring
53 Slider-Side Regulating Portion
60 Slider For Slide Fastener
61 Stopper Hook
62 Leaf Spring (Spring Portion)
70 Slider For Slide Fastener
71 Slider Main Body
74 Pull Tab Attachment Post (Pull Tab Attachment Portion)
77 Slider-Side Regulating Portion
73 Pull Tab-Side Regulating Portion
72 Leaf Spring
SP Starting Point
EP End Point

The invention claimed is:

1. A slider for a slide fastener comprising:
a slider main body configured to engage and disengage a pair of fastener elements;
a pull tab which is attached to a pull tab attachment portion of the slider main body;
a stopper hook having one end configured to be engaged with the fastener elements to stop the slider main body from moving;
a spring portion;
a cam portion, wherein when the pull tab pivots from a lie-down state to an erected state, the cam portion contacts the spring portion and an elastic force of the spring portion urges the pull tab in a direction in which the pull tab returns to the lie-down state where the pull tab is lying down toward one side of the slider main body; and
regulating portions configured to stop the pull tab from pivoting further from the erected state, so that the pull tab is prevented from lying down to the other side of the slider main body,
wherein the regulating portions comprise:
pull tab-side regulating portions which are formed on the pull tab; and
slider-side regulating portions which are formed on the slider main body,
wherein the pull tab-side regulating portions are configured to abut against the slider-side regulating portions to stop the pull tab from pivoting further from the erected state,
wherein the slider main body is comprised of a slider body and a cover body which is fixed to the slider body,
wherein the cover body comprises a receiving portion which receives the stopper hook and the spring portion, and
wherein the slider-side regulating portions are formed in a part of the cover body.

2. The slider according to claim 1,
wherein the pull tab has a shaft portion, a pair of connecting rods which are connected to the shaft portion, and a knob portion which is connected to the pair of connecting rods, and
wherein the pull tab-side regulating portions are provided on at least one of the shaft portion and the pair of connecting rods of the pull tab.

3. The slider according to claim 2, wherein the pull tab-side regulating portions and the cam portion extend toward a pull tab opening portion which is defined by the shaft portion, the pair of connecting rods and the knob portion.

4. The slider according to claim 2,
wherein the cover body further comprises
an opening portion provided with a partition plate which comes into contact with the shaft portion to pivotably hold the pull tab, and
wherein the slider-side regulating portions are formed on a circumferential wall of the opening portion.

5. The slider according to claim 2, wherein the shaft portion of the pull tab contacts an upper blade of the slider main body due to the elastic force of the spring portion through the stopper hook.

6. The slider according claim 1, wherein the regulating portions stop the pull tab from pivoting further from the erected state in a direction toward the other side of the slider main body when the spring portion contacts an end point of a cam surface of the cam portion.

7. The slider according to claim 1,
wherein the lie-down state is a state where the pull tab is lying down toward a rear mouth side of the slider main body,
wherein the pull tab-side regulating portions are formed on an upper surface of the pull tab in the lie-down state, and wherein the slider-side regulating portions are formed at positions that face the upper surface of the pull tab when the pull tab pivots toward a shoulder mouth side of the slider main body.

* * * * *

UNITED STATES PATENT AND TRADEMARK OFFICE

CERTIFICATE OF CORRECTION

PATENT NO. : 9,095,192 B2
APPLICATION NO. : 13/876572
DATED : August 4, 2015
INVENTOR(S) : Yoshikazu Hamada It is certified that error appears in the above-identified patent and that said Letters Patent is hereby corrected as shown below:

In the claims,
In column 14, line 57, in claim 6, after "according" insert -- to --.

Signed and Sealed this
Twenty-ninth Day of December, 2015

Michelle K. Lee

Michelle K. Lee
*Director of the United States Patent and Trademark Office*